US009347705B2

(12) United States Patent
Crosset

(10) Patent No.: US 9,347,705 B2
(45) Date of Patent: May 24, 2016

(54) CONTINUOUS PARTICLE DRYING APPARATUS

(71) Applicant: Léon Crosset, Thimister (BE)

(72) Inventor: Léon Crosset, Thimister (BE)

( * ) Notice: Subject to any disclaimer, the term of this patent is extended or adjusted under 35 U.S.C. 154(b) by 101 days.

(21) Appl. No.: 14/382,125

(22) PCT Filed: Mar. 18, 2013

(86) PCT No.: PCT/EP2013/055510
§ 371 (c)(1),
(2) Date: Aug. 29, 2014

(87) PCT Pub. No.: WO2013/139720
PCT Pub. Date: Sep. 26, 2013

(65) Prior Publication Data

US 2015/0013179 A1 Jan. 15, 2015

(30) Foreign Application Priority Data

Mar. 21, 2012 (BE) ..... 2012/0196

(51) Int. Cl.
*F26B 21/02* (2006.01)
*F26B 3/02* (2006.01)
(Continued)

(52) U.S. Cl.
CPC ..... *F26B 3/02* (2013.01); *F26B 17/005* (2013.01); *F26B 23/001* (2013.01); *F26B 25/003* (2013.01); *F26B 2200/24* (2013.01)

(58) Field of Classification Search
CPC ..... F26B 17/00; F26B 21/00; F26B 21/02; F26B 25/00; F26B 25/003; A23N 1/00; A23N 17/00; A23N 17/005; B04C 3/00; B04C 3/04
USPC ..... 34/487, 86, 90, 213; 422/307; 99/316
See application file for complete search history.

(56) References Cited

U.S. PATENT DOCUMENTS 5,561,916 A * 10/1996 Willgohs ..... F26B 3/084 165/104.16
5,809,664 A * 9/1998 Legros ..... F26B 3/088 159/4.01

(Continued)

FOREIGN PATENT DOCUMENTS

DE 3616411 A1 11/1987
DE 102010013083 A1 9/2011

(Continued)

OTHER PUBLICATIONS

International Search Report for Application No. PCT/EP2013/055510 dated Jun. 6, 2013.

*Primary Examiner* — Stephen M Gravini
(74) *Attorney, Agent, or Firm* — Norris McLaughlin & Marcus, P.A.

(57) ABSTRACT

A dryer dries particles, wherein the dryer comprises two circular decks mounted substantially horizontally and rotating in opposite directions relative to one another about a same vertical axis, Z, the surface of said decks being perforated and permeable to air, steam and water, a means for blowing hot gas in a flow substantially parallel to the axis Z, passing through the second deck before passing through the first deck, means for distributing said particles to be dried on the first and second decks and means for recovering the particles after a rotation of each deck, and a means for transferring the particles collected from the first deck by the recovery means to a second distribution means suitable for distributing said particles along a radius of the second deck.

17 Claims, 7 Drawing Sheets

(51) Int. Cl.

| | |
|---|---|
| ***F26B 17/00*** | (2006.01) |
| ***F26B 23/00*** | (2006.01) |
| ***F26B 25/00*** | (2006.01) |

(56) References Cited

U.S. PATENT DOCUMENTS

| | | | | |
|---|---|---|---|---|
| 5,950,325 | A * | 9/1999 | Mehdizadeh | F26B 3/343 219/701 |
| 6,065,224 | A * | 5/2000 | Eigner | C05F 17/0247 34/135 |
| 7,380,348 | B2 * | 6/2008 | Seebach | B04C 3/00 34/326 |
| 8,161,663 | B2 * | 4/2012 | Weisselberg | C10L 9/083 202/109 |
| 8,745,890 | B2 | 6/2014 | Niemann et al. | |
| 8,793,900 | B2 * | 8/2014 | Moretto | B29B 13/065 34/137 |
| 9,234,701 | B2 * | 1/2016 | Wada | B02C 13/282 |
| 2015/0013179 | A1 * | 1/2015 | Crosset | F26B 17/005 34/487 |
| 2016/0054059 | A1 * | 2/2016 | Forsyth | F26B 11/12 34/594 |

FOREIGN PATENT DOCUMENTS

| | | | | |
|---|---|---|---|---|
| EP | 0197171 | B1 | 10/1986 | |
| GB | 265374 | A | 2/1927 | |
| GB | 406272 | A * | 2/1934 | B02C 11/08 |
| JP | 2001152870 | A * | 6/2001 | |
| WO | 2011/062638 | A2 | 5/2011 | |

* cited by examiner

CONTINUOUS PARTICLE DRYING APPARATUS

This application is a 371 application of PCT/EP2013/055510 filed Mar. 18, 2013, which claims foreign priority benefit under 35 U.S.C. §119 of Belgium Application No. BE 2012/0196 filed Mar. 21, 2012.

FIELD OF THE INVENTION

The invention relates to an industrial dryer for drying organic particles, for example of agri-foodstuff origin, such as cereals, or waste used as fuel.

TECHNOLOGICAL BACKGROUND

Many industrial methods require particles to be dried before their subsequent use, whether before the packaging of granular agri-foodstuff products or of industrial products, or before the combustion of ground waste used as fuels. It is of course possible to perform the drying of the particles in batches by depositing the particles on decks or in a rotary drum, preferably perforated in order to allow a hot gas to pass through and allow water and steam to escape. In some cases, a fluidized bed is formed by the particles in suspension under the action of the flow of hot gas. However, most of the industrial applications require flow rates that a batch drying method cannot achieve. For this reason, the same principle of depositing the particles to be dried on a perforated support and of exposing them to a flow of hot gas has been applied to apparatus used for continuous drying, with a continuous source of the particles to be dried upstream of the dryer itself and a continuous discharging of the dried particles downstream thereof.

In particular, a belt dryer is schematically illustrated in FIG. 1(*a*) and comprises a continuous perforated flexible belt stretched between two motor-driven rollers forming a loop. Air or other hot gas is blown under the upper cloth on which the particles to be dried are continuously deposited. The length of a belt dryer depends on the type of particles to be dried and their water content. Typically, if a surface area of 120 $m^2$ is necessary to dry the particles at the desired speeds, the belt will have to have a surface area at least two times greater, of the order of 250 $m^2$, because the particles are dried only on the top part of the loop linking the two rollers. For a width of 2.5 m, a belt 200 m long would therefore be required to link two rollers approximately 80 m apart. A belt of such dimensions is very expensive, and difficult to mount/remove on the apparatus. A belt dryer is therefore generally reserved for the drying of a single type of particles, because it would be uneconomical to change the belt to optimize the type of perforation to a new type of particles. Should the belt be damaged, the entire unit has to be stopped for a long time, the time it takes to change or repair the belt. To support a belt over such a length, many support rollers mounted on bearings are necessary, which increases the cost and also the risks of failure of such an apparatus. A belt dryer is therefore very costly and ineffective in terms of dimension, since the particles are dried only over less than half of the length of the belt.

There are also perforated deck dryers as represented schematically in FIG. 1(*b*), which resemble belt dryers, except that the belt is replaced by perforated decks coupled to one another forming a sort of caterpillar track. The difference with a belt dryer is that the decks are articulated so as to present the same face whether they are the top or bottom belt of the loop. This makes it possible to reduce the length of the dryer practically by half, since the particles are subjected twice to a flow of hot gas: the first time in their passage over the top part of the loop and the second time in their passage in the reverse direction over the bottom part. Although advantageous from this point of view relative to a belt dryer, it is clear that the mechanics necessary for the movements of the decks are delicate and therefore costly and fragile, especially when exposed to fine particles that can seize up the rolling bearings. Furthermore, the openings created between two adjacent decks and, above all, the spaces opening up in the deck transfer mechanism in each transfer of a deck from the top portion to the bottom portion of the caterpillar track create so many preferential passages of lesser resistance for the flow of hot gas, which result in a significant drop in the efficiency of this type of dryer.

EP197171 describes a dryer represented schematically in FIG. 1(*c*) (without the powder distribution and recovery means to simplify the figure) and comprising a number of superposed, circular, perforated decks (1*a*, 1*b*) mounted to rotate on a hollow central axis. Each deck is enclosed in an individual cylindrical chamber provided with a roof [18] and a floor which separate it from the other decks. Means (4*a*) for transferring the powder to be dried are provided between each adjacent deck (see gray arrow (4*a*)). Each chamber is provided, on the one hand, with a first hot air intake opening, fluidically connected with the cavity of the hollow central axis, said first opening being positioned above the deck located in the corresponding chamber and, on the other hand, a second exhaust opening on the peripheral wall of the chamber connected with the outside (or a hot air exhaust system), said second opening being located under the corresponding deck. Hot air is blown into the cavity of the hollow axis according to the black arrows in FIG. 1(*c*) and is distributed in parallel into each chamber through the first hot air intake opening. The hot air has to pass through the circular perforated deck before being discharged through the second opening located on the peripheral wall of each chamber. In reality, such a system is similar in principle to a belt dryer (see FIG. 1(*a*)), whose linear motion has been replaced by a circular motion distributed over a plurality of levels with means for transferring powder from one deck to another. Such a rotary system does indeed have a considerable advantage of space-saving on the ground compared to a linear belt dryer, but such a system lacks efficiency. In practice, while the hot air having passed through the first decks loaded with very wet particles emerges relatively saturated with moisture, the hot air passing through the final decks loaded with particles already partially dried on the preceding decks emerges with very little moisture content, which represents a considerable waste of energy.

There therefore remains a need for an industrial dryer for drying particles continuously which is effective, easy to maintain, occupying less space on the ground and less expensive. The present invention proposes such an industrial dryer.

SUMMARY OF THE INVENTION

The present invention is defined in the independent claims. Preferred variants are defined in the dependent claims. In particular, the present invention relates to a dryer for drying particles comprising, (a) a first circular deck mounted substantially horizontally rotating in a first direction about a vertical axis, Z, the surface of said deck being perforated and permeable to the gases such as air and steam and to water, (b) a second circular deck mounted substantially horizontally at a certain distance from the first deck, rotating about said vertical axis, Z, in the reverse direction of rotation of the first deck, the surface of said deck being perforated and permeable to the gases such as air and steam and to water, (c) a means for blowing hot gas in a flow substantially parallel to the axis Z, passing first through the second deck before passing directly after through the first deck, (d) a first means for distributing said particles to be dried suitable for distributing said particles before drying along a radius of the first deck, (e) a means for recovering the particles deposited on the first deck after a rotation of a given angle thereof, said recovery means being situated downstream of, preferably adjacent to, the first distribution means, (f) a means for transferring the particles collected from the first deck by the recovery means to a second distribution means suitable for distributing said particles along a radius of the second deck.

In a first variant of the invention, the first deck is situated below the second deck and the hot gas is preferably hot air circulating from top to bottom, whereas, in a second variant, the first deck is situated above the second deck and the hot gas circulates from bottom to top. The first variant has, among other things, the advantage that the hot gas presses the particles against the surface of the decks which can be advantageous in terms of reducing the dust generated in the case of fine particles. The second variant has the advantage that the transfer of the partially dried particles from the upper first deck to the lower second deck is facilitated by gravity, which can be particularly advantageous for particles of high density.

Each deck can advantageously comprise a self-supporting rigid structure with high permeability of grating type, on which is placed a filtering layer comprising openings of size and density corresponding to the desired permeability according to the type and size of the particles to be dried. This solution offers great flexibility because it is very easy to replace a perforated plate, a screen, a grid or even a fabric on a grating to successively dry particles of very different granule sizes, which is practically unfeasible with a belt or pallet dryer.

The first and second means for distributing the particles to be dried on the first and second decks, respectively, preferably each comprise at least one Archimedes screw extending along a radius of the first and second decks, respectively. The Archimedes screw(s) are enclosed in a chamber provided with one or more openings extending along said radius of the decks and enabling the particles to be sprinkled onto the deck located directly below.

Similarly, the recovery means of the first deck preferably comprises at least one Archimedes screw extending along a radius of said deck which is enclosed in a chamber provided with one or more openings extending along said radius of the first deck. The openings are linked to a scraper or brush suitable for collecting and directing the particles brought by the rotation of the deck to the Archimedes screw. It is advantageous for the second deck also to comprise a means for recovering the particles deposited on the second deck and dried after a rotation of a given angle thereof, said recovery means being situated downstream of, preferably adjacent to, the second distribution means. It is preferable for the recovery means of the second deck to be similar to that of the first deck discussed above.

A third circular deck can be mounted substantially horizontally at a certain distance from, and separated from the first deck by, the second deck, rotating about said vertical axis, Z, in the reverse direction of rotation of the second deck, the surface of said deck being perforated and permeable to the gases such as air and steam and to water. A transfer means makes it possible to transfer the particles collected from the second deck by the second recovery means discussed above to a third distribution means suitable for distributing said particles along a radius of the third deck. This configuration makes it possible to reduce the radius of the disks and therefore the surface area on the ground occupied by the dryer, but it is obviously taller.

In order to collect the fine particles having passed through the lower deck and building up on the floor of the dryer, the latter preferably comprises an opening for discharging these particles. Furthermore, a scraper is preferably securely fixed to the lower deck and suitable for following the rotational motion thereof to push the particles deposited on the floor toward said discharge opening.

The drying area itself is preferably contained between an outer cylindrical wall of a diameter corresponding to that of the disks, and an inner cylindrical wall, coaxial to the outer wall, and defining a hollow chamber centered on the axis Z of rotation of the decks. The inner wall extends continuously at least from the upper deck to the lower deck. The chamber can advantageously accommodate the fans needed to create the gas flow or the motor driving the rotation of the decks and thus attenuate the noise pollution. It also enables an operator to access different mechanical elements from the interior for the servicing and repairing of the machine.

A second or even a third dryer as described above can be superposed on the first dryer and thus multiply the drying capacity for the same footprint on the ground. A source of particles to be dried, such as a silo, can be linked upstream to the first distribution means for the particles to be dried on the first deck. For example, the particles to be dried can be agrifoodstuff products such as cereals, fertilizer or tealeaves, ground organic waste to be dried for use as fuel, particular cosmetic or pharmaceutical products, pigments, polymer granules, ceramic powders, etc. Downstream, a storage and/or packaging unit can be incorporated.

In the case of the drying of particles for use as fuel, the dryer can be linked downstream to a boiler supplied with dried particles as fuel. This boiler can be linked to a turbine supplied with steam at a temperature, T1, by the boiler, which activates an electrical current generator. The steam or the liquid obtained from the turbine can be sent at a temperature, $T2<T1$, to a heat exchanger to heat the air of the hot gas blowing means of the dryer and/or of another dryer.

BRIEF DESCRIPTION OF THE FIGURES

For a better understanding of the nature of the present invention, reference is made to the following figures, including.

DETAILED DESCRIPTION OF PARTICULAR EMBODIMENTS

Figure 1:
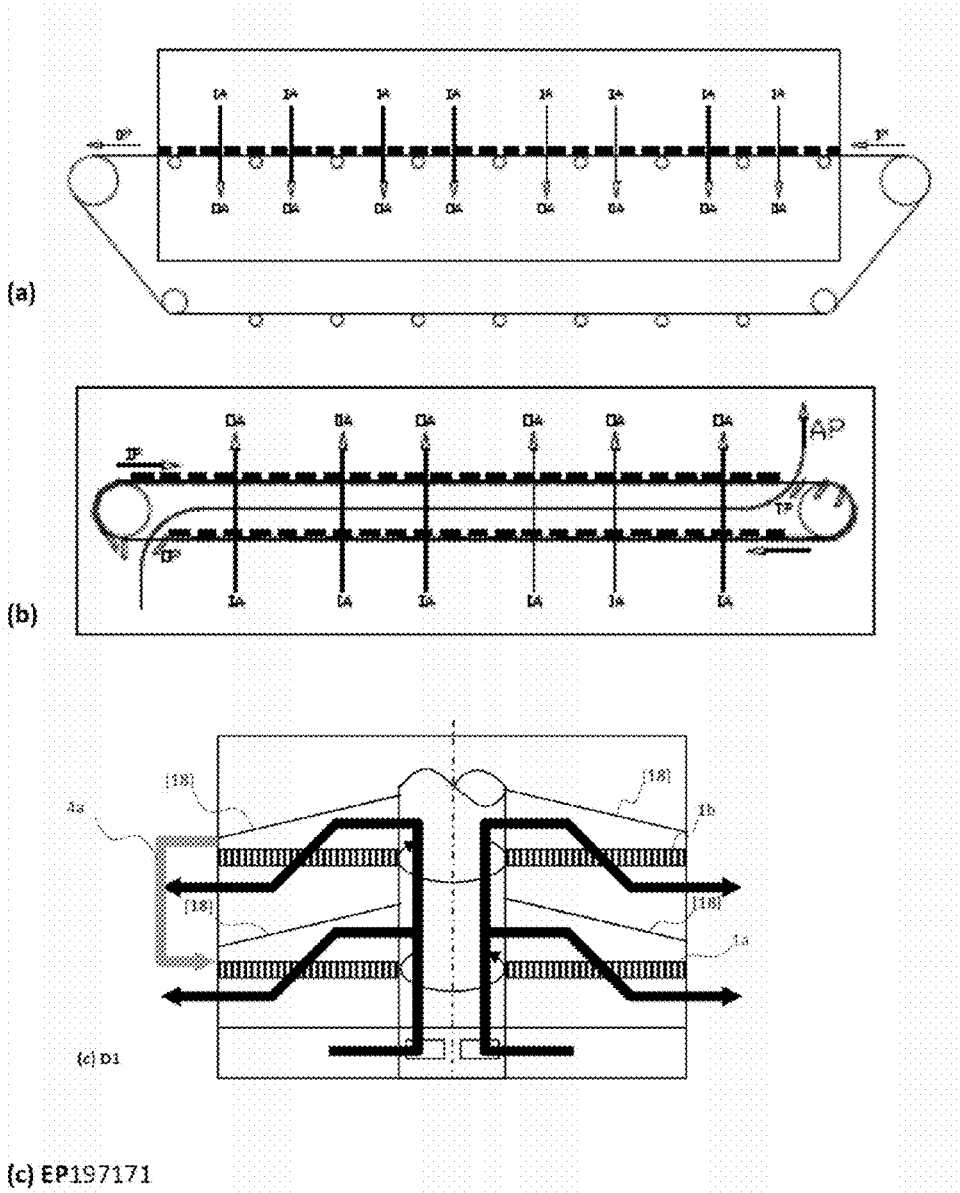
FIG. 1: illustrates (*a*) a belt dryer, (*b*) a pallet dryer, of the prior art, and (*c*) a dryer according to EP 197171.
Figure 2:
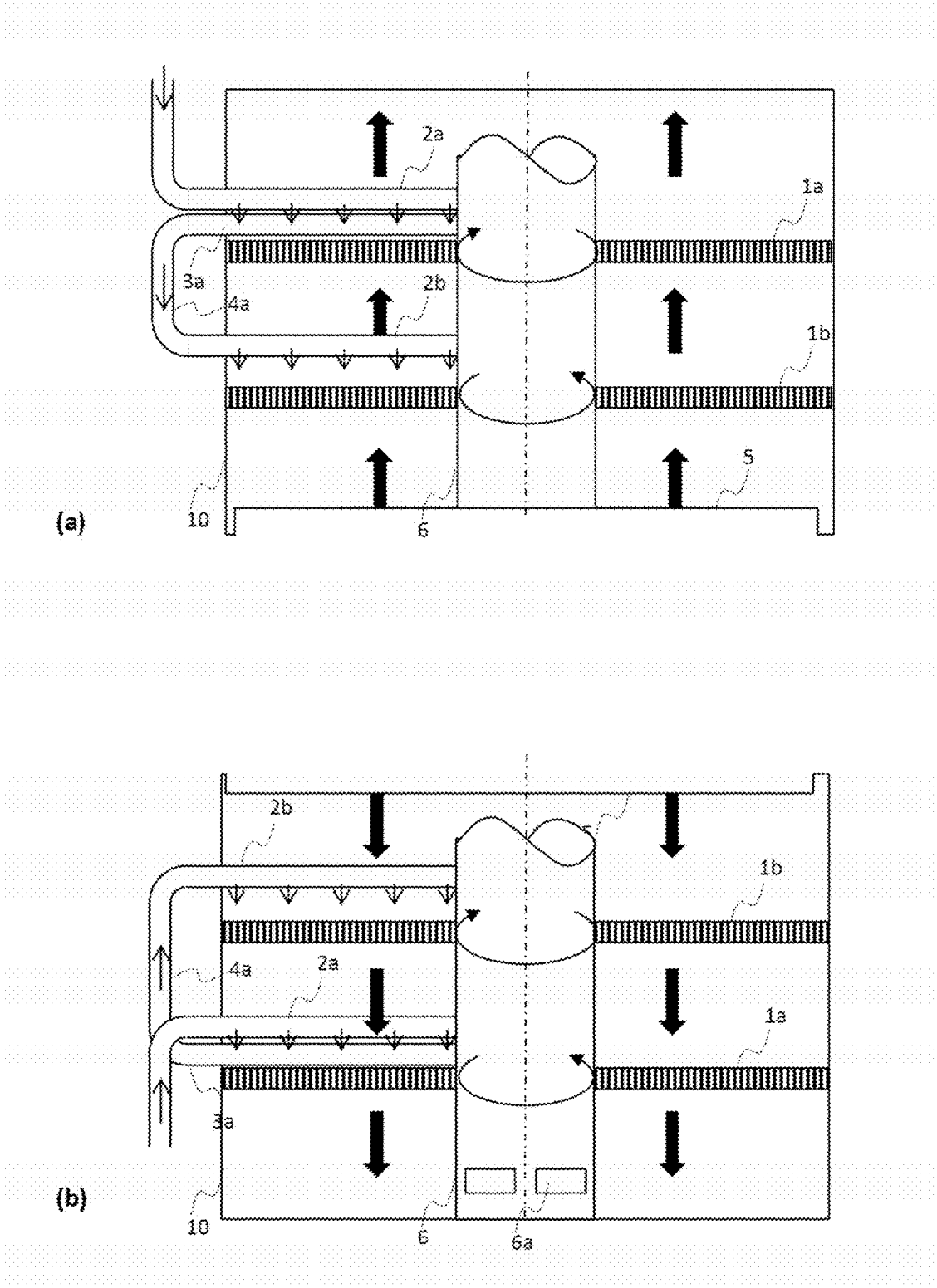
FIG. 2: schematically illustrates two variants of the present invention.
Figure 3:
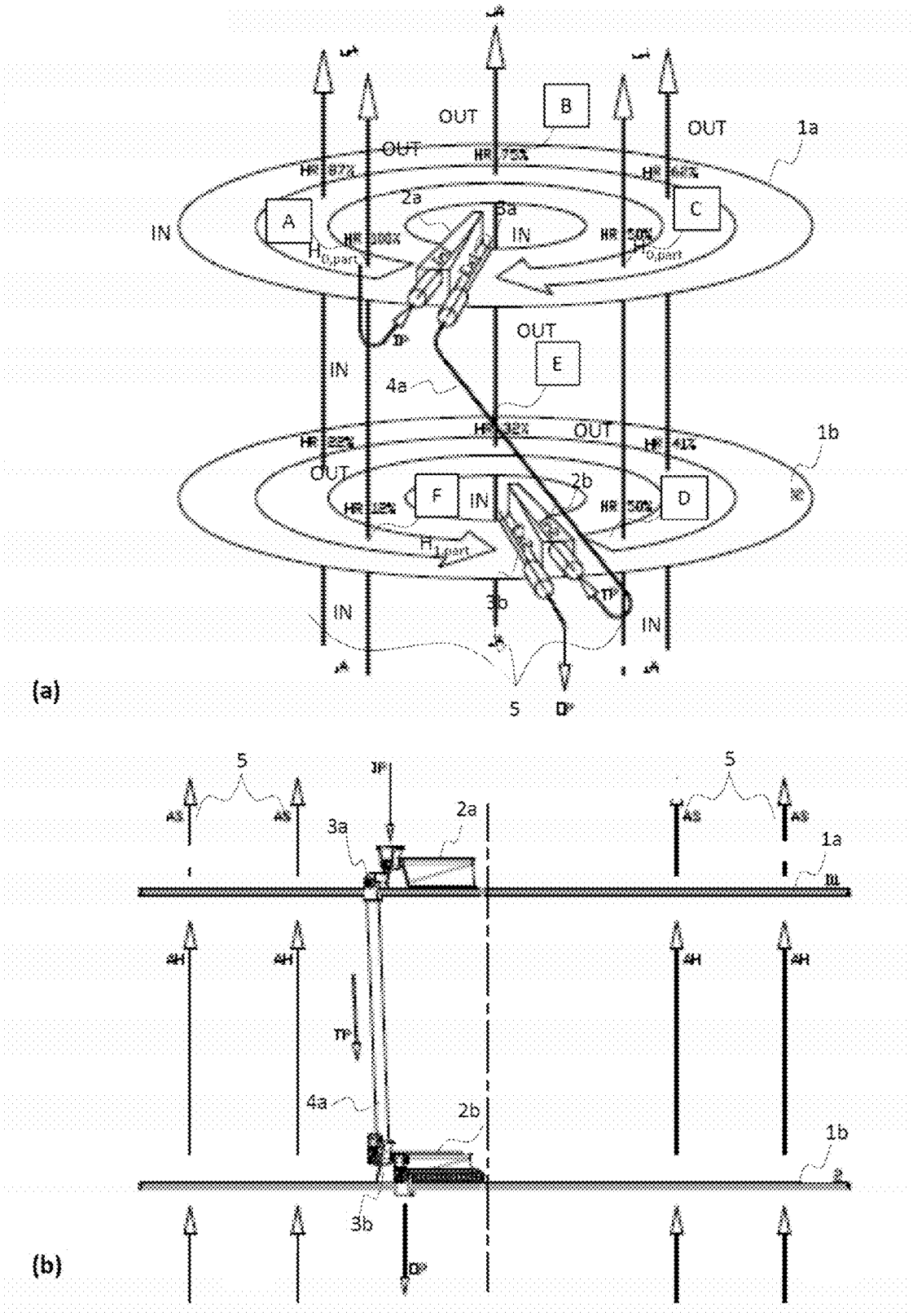
FIG. 3: illustrates the variant of FIG. 2(*a*).
Figure 4:
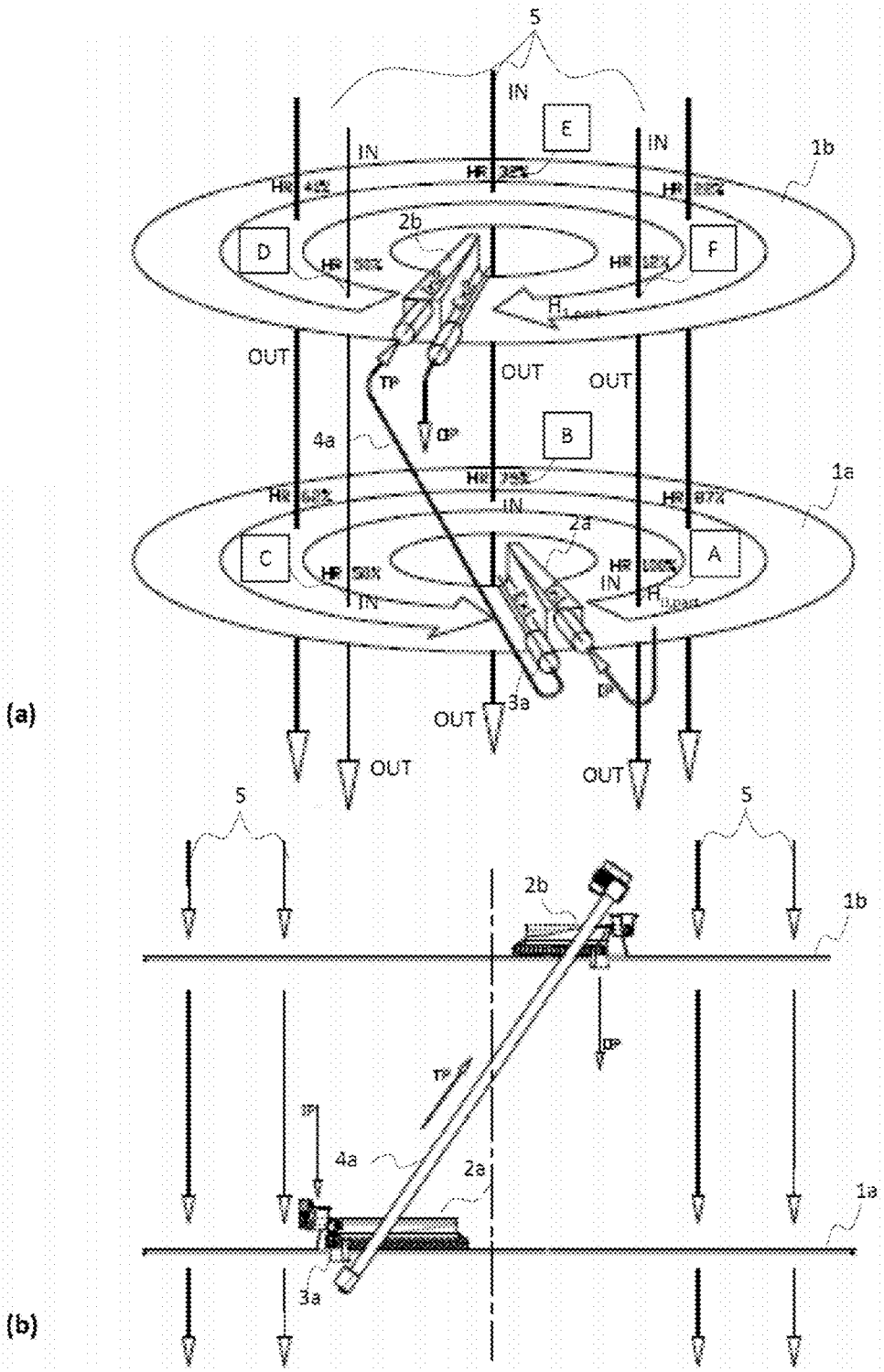
FIG. 4: illustrates the variant of FIG. 2(*b*).

Unlike the linear motion of the belt or perforated deck dryers currently available on the market for drying particles and represented schematically in FIG. 1, the dryer of the present invention is based on the rotary motions in opposite directions of at least one first and one second superposed deck (1*a*, 1*b*). This approach allows for the design of particle drying equipment to be much more compact than the dryers with linear motion. In particular and as illustrated in FIGS. 2 to 4, a dryer according to the present invention comprises a first circular deck (1*a*) mounted substantially horizontally in rotation in a first direction about a vertical axis, Z, the surface of said deck being perforated and permeable to the gases such as air and steam and to water. A motor (7*a*) rotates the first deck (1*a*). A first means (2*a*) for distributing said particles to be dried is mounted above the first deck so as to be able to distribute said particles before drying along a radius of the first deck (1*a*). A first means (3*a*) for recovering the particles deposited on the first deck (1*a*) after a rotation of a given angle thereof is mounted downstream of the first distribution means (2*a*). In order to increase the drying time of the particles deposited on the first deck (1*a*), the first recovery means (3*a*) is preferably adjacent to the first distribution means (2*a*), the two means extending preferably along two radii of the disk.

A means (4*a*) for transferring the particles collected from the first deck (1*a*) by the recovery means (2*a*) makes it possible to transfer them to a second deck via a second distribution means (2*b*) suitable for distributing said particles along a radius of the second circular deck (1*b*). The second circular deck (1*b*) is similar to the first deck (1*a*) and is mounted substantially horizontally at a certain distance therefrom, rotating about said vertical axis, Z, but in the reverse direction of rotation of the first deck. Like that of the first deck (1*b*), the surface of the second deck (1*b*) is perforated and permeable to the gases such as air and steam and to water. The rotation of the second deck (1*b*) is also motor-driven by a motor (7*b*) which can be the same as or different from the motor (7*a*) allowing for the rotation of the first deck (1*a*).

In a preferred variant of the invention, the second deck (1*b*) also comprises a means (3*b*) for recovering the particles deposited on the second deck after a rotation of a given angle thereof, said recovery means being situated downstream of, preferably adjacent to, the second distribution means (2*b*) and preferably being similar to the recovery means of the first deck.

Figure 6:
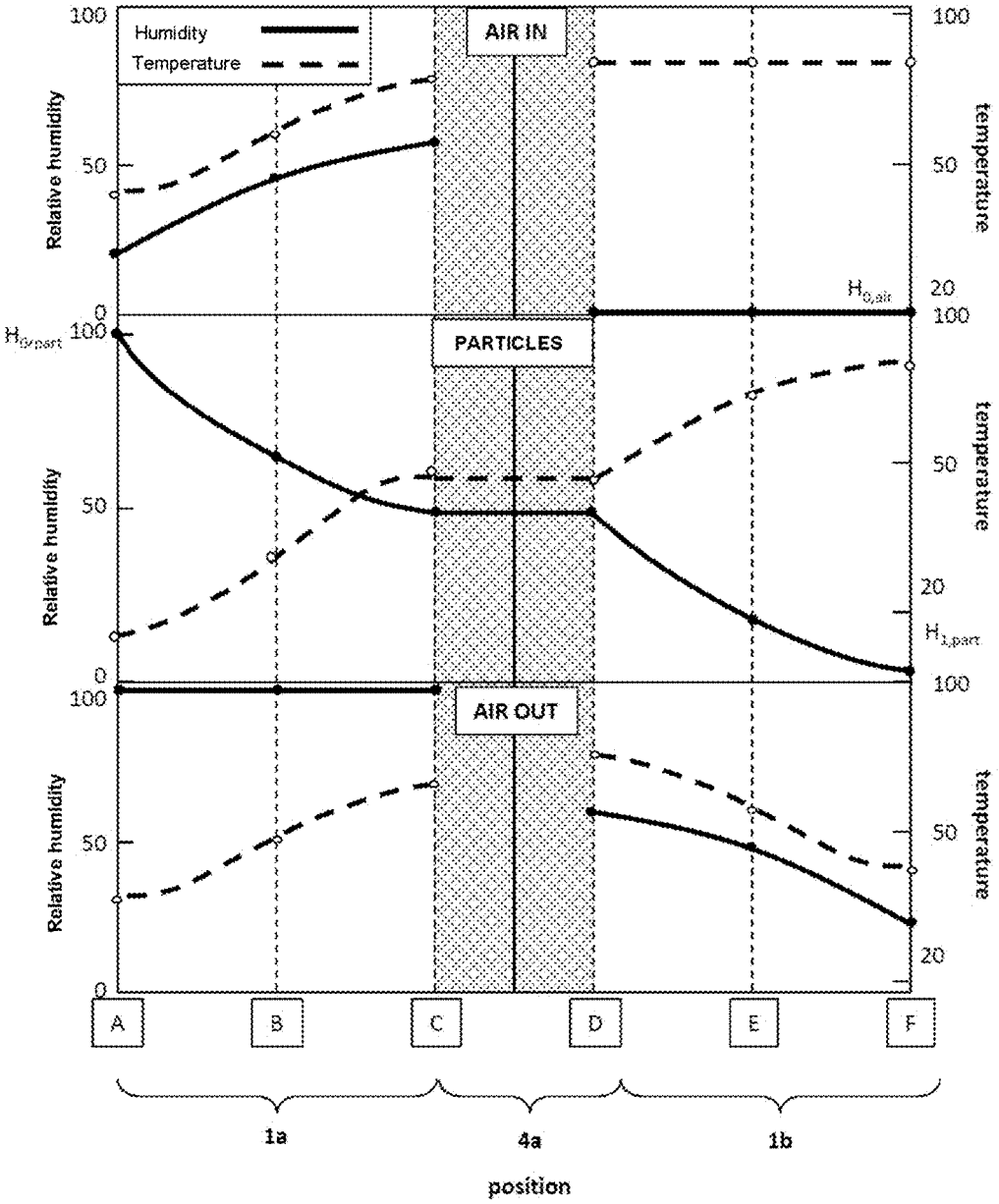
FIG. 6: graphically illustrates the trend of the water content (continuous line) and of the temperature (broken line) of the particles and of the gas incoming (AIR IN) to and outgoing (AIR OUT) from a deck as a function of the angular position on the first and second decks.

The drying of the particles deposited on the first perforated deck (1*a*), transferred after a given rotation of said first deck to the second perforated deck (1*b*) and in rotation, is ensured by a means (5) for blowing hot gas in a flow substantially parallel to the axis Z, passing through the second deck (1*b*) before passing through the first deck (1*a*), thus defining a counterflow drying system. It is important that the hot and dry gas flow passes first through the second deck, where the particles are already partially dried by their time on the first deck, which in turn is reached by a hot gas flow partially charged with moisture after the passage through the second deck. The advantage of such a counterflow drying system is schematically illustrated in FIGS. 3, 4 and 6. FIG. 6 schematically shows the water content (continuous line) and the temperature (broken line) of the particles (middle graph, "particles") and of the gas (often air) upstream (top graph, "air in") and downstream (bottom graph, "air out") of each deck, for positions A to F on the first and second decks (1*a*, 1*b*) as indicated in FIGS. 3(*a*) and 4(*a*). The relative humidity axis indicates the water content of the particles in their travel through the dryer and of the air upstream (air in) and downstream (air out) of the first and second decks, respectively, at a given angular position A to F relative to their initial water content, calculated as $(H-H_0)/(H_1-H_0)$ where H is the water content of the particles and of the air upstream of the first and second decks at a given angular position, $H_0$ is their water content before any contact between the gas and the particles and $H_1$ is their water content at the end of the drying method, that is to say of the particles that have reached the second recovery means (3*b*), and of the air downstream of the first deck (1*a*).

The particles (middle graph, "particles") are distributed on the first deck (1*a*) with their maximum initial content, $H_{0,part}$ visible to the left of the graph, at position A of the first deck (1*a*) of FIG. 6 (continuous line). In FIG. 3(*a*), this corresponds to the left of the distributor (2*a*) of the top first deck (1*a*), whereas, in FIG. 4(*a*), this corresponds to the position to the right of the distributor (2*a*) of the lower first deck (1*a*). The particles are first carried by the rotation of the first deck (1*a*) by moving toward the right of the graph of FIG. 6 passing through the positions B and C before being recovered by the means (3*a*) and transferred to the position D of the second deck by the transfer means (4*a*). During the rotation of the first deck and of the particles located thereon, the moisture content of said particles decreases under the action of the hot gas flow (continuous curve of the "particles" graph of FIG. 6). The particles arrive at D on the second deck partially dried and begin a second rotation in the reverse direction where the hot air flow finishes drying them until they reach their final moisture content, $H_{1,part}$, at position F visible to the extreme right of the graph of FIG. 6, after having passed through the position E of the second deck (1*b*).

The hot gas, for example hot air or any other gas obtained from a combustion method, follows a reverse path to that of the particles. In the graph of FIG. 6, the gas starts from the right half of the graph, with an initial moisture content $H_{0,air}$, that is constant and low, upstream of the second deck (see AIR IN, second deck (1*b*)). When the air passes through the second deck (1*b*), it transfers some of calorific and kinetic energy to the particles of the second deck (1*b*) which are reheated (see broken line in the "particles" graph on the second deck (1*b*)) and is charged with, and drives with it, a portion of the moisture of the particles (see "air out" of the second deck (1*b*)). The air outgoing from the second deck (1*b*) is the air incoming into the first deck (1*a*) (AIR OUT (1*b*)=AIR IN (1*a*)), but, since the first deck rotates in the reverse direction to the second deck, the curves are reversed. It can be seen that the air arriving at the position A where the particles are most moist is drier than the air arriving at position C where the particles are already partially dried. Thus, by passing through the first deck (1*a*), the drier air passes at A through the most moist particles and will thus emerge therefrom saturated with water, and the partially moist air passes at C through the partially dried particles and will therefore emerge therefrom also saturated with water, thus optimizing the transfer of energy from the air to the particles and of moisture from the particles to the air. This optimization is obtained while ensuring an equipment item that is particularly compact, easy to use, easy to maintain and, above all, that makes it possible to easily dry particles of very different granule sizes.

The application EP197171 mentioned in the introduction describes a dryer schematically illustrated in FIG. 1(*c*) and which, at first sight, seems similar to that of the present invention. In reality, it differs from the dryer of the present invention notably in that the hot gas passes through only a single deck before being discharged. In practice, roofs [18] separating a second deck (1*b*) from a first deck (1*a*) prevent the hot air from passing from said second deck (1*b*) to the first deck (1*a*). Since the hot air rises in the cavity of the central axis of rotation where it is distributed to first, second and other decks, that it passes through individually before being discharged, it can be called a parallel hot air distribution system (see FIG. 1(*c*)). By contrast, the hot air distribution system in a dryer according to the present invention is in series, which makes it possible to obtain an optimization of the drying as described above, which is considerably greater than that of a parallel system like that of a dryer according to EP197171.

The sequence of superposition of the first and second deck (1*a*, 1*b*) depends on the applications and preferences. For example, as represented in FIGS. 2(*a*) and 3, the first deck (1*a*) can be situated above the second deck (1*b*) and the hot gas (for example hot air) circulates from bottom to top. An advantage of this variant is that the transfer of the partially dried particles from the upper first deck (1*a*) to the lower second deck (1*b*) by the transfer means (4*a*) is done from top to bottom, assisted by gravity. However, since the hot gas flow circulates from bottom to top through the second and first decks, respectively, the particles can take off and create dust. A slight fluidization of the bed of particles can be advantageous for the drying thereof, but it is essential to avoid forming a cloud of fine dust in suspension in the air. This configuration is therefore better suited to the drying of heavy particles which do not easily form a cloud of dust.

For lighter or finer particles, the first deck (1*a*) can, on the contrary, be situated below the second deck (1*b*) and the hot gas circulates from top to bottom, as represented in FIGS. 2(*b*) and 4. In this configuration, the particles are pressed against the deck on which they are located which considerably reduces the creation of dust suspension. A hot gas flow from top to bottom risks forming compact clusters that are agglomerated between them and difficult to dry. These compact clusters are, however, dislodged upon the recovery of the particles from the first deck and their transfer to the second deck, which makes it possible to further increase the effectiveness of the drying by re-separating and re-mixing the duly agglomerated particles. This configuration also has the advantage, for the fine particles that easily form a cloud of dust with all the attendant explosion hazards, because the hot air passes first through the upper second deck (1*b*) before passing through the lower first deck (1*a*). Since the upper second deck is charged with particles that are already partially dried, dry and volatile fine dust can pass through the orifices of the second perforated deck and generate a cloud below it. However, the hot air pushes this cloud toward the first deck (1*a*) located directly below, which is the one charged with moist particles. A moisture gradient of the particles is observed in the thickness of the layer with the particles located below, close to the surface of the first deck, being heavily charged with moisture. The latter therefore form a sort of paste acting a little like a filter which prevents the cloud of fine particles from passing through the first deck (1*a*) and being lost in the bottom part of the dryer.

The dryer according to the present invention is particularly advantageous because it can be used to dry particles of very different granule sizes, ranging from fine particles such as sawdust, fine grains, ceramic, polymer or metallic powders, to larger particles, such as wood waste, chips, pellets, agricultural waste, maize or malt husks, etc., by rapidly and easily changing the diameter of the orifices of the decks as follows. The first and second decks (1*a*, 1*b*) can thus comprise a self-supporting rigid structure with high permeability of grating type, on which is placed a filtering layer comprising openings of a size and density corresponding to the desired permeability depending on the type and the granule size of the particles to be dried. The filtering layer can be a perforated plate, a screen, a grid or a fabric. To facilitate the placement of such a filtering layer, it can be cut into angular segments, that can be placed and fixed side by side directly on the gratings or other self-supporting structure with high permeability. This would be impossible in practice in belt or perforated deck dryers which are dedicated to drying particles of a single type of granule size.

The purpose of the first and second means (2*a*, 2*b*) for distributing the particles to be dried on the first and second decks (1*a*, 1*b*), respectively, is to distribute the particles to be dried uniformly along a radius of the corresponding decks. Generally, the distribution means (2*a*, 2*b*) therefore comprise:

- a structure extending from the outer periphery to the inner periphery of a deck, preferably along a radius thereof,
- means for transporting the particles from the outer periphery to the inner periphery of the decks, and finally
- means for depositing said particles from the transport means to the decks.

There are a number of possible solutions. For example, the transporting of the particles from the outer periphery to the inner periphery of the decks can be assured by a conveyor belt, either perforated, or inclined transversely so as to enable the particles to sprinkle the deck situated below. To assist in the sprinkling, the belt can be vibrated. In an alternative and preferred variant, the distribution means (2*a*, 2*b*) comprise at least one Archimedes screw extending along a radius of the first and second decks (1*a*, 1*b*), respectively, in order to transport the particles from the outer periphery to the inner periphery of the corresponding deck. Said at least one Archimedes screw is enclosed in a chamber provided with one or more openings extending downward and along said radius of the decks (1*a*, 1*b*) in order to enable the particles to be sprinkled on said decks.

The recovery means (3*a*) of the first deck (1*a*), and, if there is one, the recovery means (3*b*) of the second deck (1*b*), preferably comprise at least one Archimedes screw extending along a radius of said decks which is enclosed in a chamber provided with one or more openings extending along said radius of the corresponding deck. The openings are linked to a scraper or brush suitable for collecting and directing the particles brought by the rotation of the deck to the Archimedes screw. The type of means (4*a*) for transferring the particles from the first deck (1*a*) to the second deck (1*b*) depends on the configuration of the dryer. If the first deck (1*a*) is the upper deck, the transfer means can be a simple tube linking the recovery means (3*a*) of the first deck to the distribution means (2*b*) of the second deck, in which the particles fall by gravity. If, however, the first deck is the lower deck, it is preferable for the transfer means (4*a*) to comprise an Archimedes screw making it possible to raise the particles from the lower first deck to the upper second deck.

The figures illustrate dryers comprising two decks. However, to reduce the footprint occupied by the equipment, it is perfectly possible to mount:

at least one third circular deck mounted substantially horizontally at a certain distance from, and separated from the first deck (1*a*) by, the second deck (1*b*), rotating about said vertical axis, Z, in the reverse direction of rotation of the second deck, the surface of said deck being perforated and permeable to the gases such as air and steam and to water, and a means for transferring the particles collected from the second deck (1*b*) by the recovery means (3*b*) to a third distribution means suitable for distributing said particles along a radius of the third deck.

It is obvious that it is possible to mount as many parallel decks in rotation about the axis Z as are desired and according to the needs of a particular application. However, a dryer comprising two decks (1*a*, 1*b*) is suitable for most applications. The use of several superposed decks makes it possible to reduce the outer diameter of the disks.

With a view to the distribution of the granule size of the particles of the same type, it is difficult to avoid having the finest fraction of the particles pass through the perforations of the decks and fall onto the lower deck or decks, then onto the floor of the chamber enclosing the decks. In order to avoid too great an accumulation of particles on the floor and also to recover them, it is advantageous to provide the floor with an opening for discharging the finest particles which would be deposited on the floor. Furthermore, a scraper or brush securely fixed to the lower deck and suitable for following the rotational motion thereof can be used to push the particles deposited on the floor to said discharge opening. Since the scraper or brush is fixed to the lower deck, it is not necessary for it to be individually motor-driven.

Figure 5:
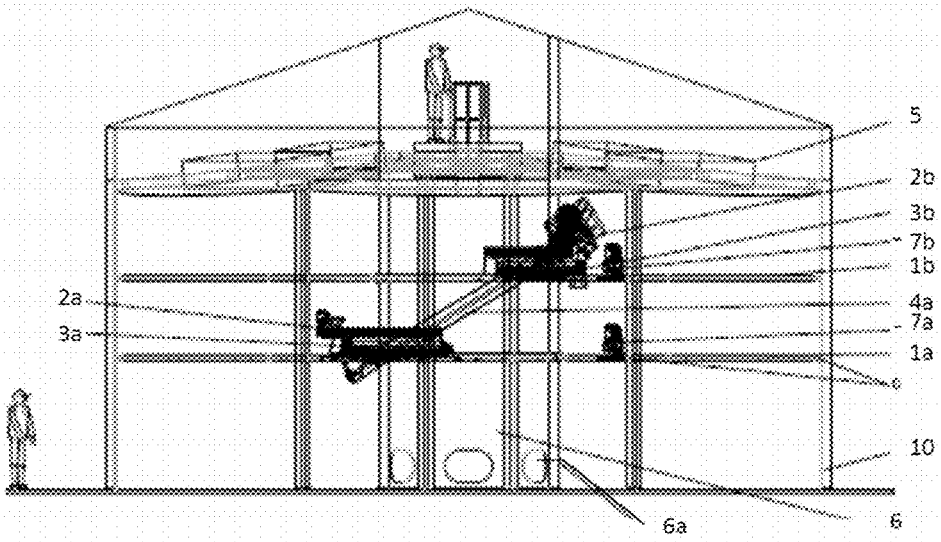
FIG. 5: illustrates an embodiment of the present invention.

As illustrated in FIG. 5, the decks (1*a*, 1*b*) are preferably enclosed in an outer chamber (10) of a diameter corresponding to the diameter of the decks with enough margin to avoid friction, but as small as possible to make it possible to seal the interface between the decks and the outer wall (10). The seal can be ensured for example by a flexible skirt fixed to the outer wall and resting on a raised rim of the circumference of the disks. In this way, the bed of particles resting on a disk in rotation is not in contact with the static skirt, thus ensuring a good seal and an integrity of the bed of particles on the deck. This is not possible to produce on a belt dryer, in which the sealing skirt is placed between the rolling belt and the particles located on the edges of the belt. There is therefore a fringe of particles in contact with the static skirt at each edge of the belt which does not move at the same speed as the particles located in the middle of the belt.

The central part of the decks is preferably hollow and surrounded by an inner cylindrical chamber (6) centered on the axis of rotation Z, as represented in FIGS. 2 and 5. Such a chamber rising practically over the entire height of the dryer, in any case between the upper and lower decks, has numerous advantages, which amply compensate for the loss of surface area available for the drying. In practice, if the outer diameter of the disks is D1 and the diameter of the inner cylindrical chamber (6) is n×D1, where n<1, the loss of surface area available on each deck for the drying between a full disk and a disk comprising an inner chamber is only $n^2$. For example, if the inner chamber has a third of the diameter of the outer chamber, the loss of surface area available for the drying is only ⅑≅11%. An inner chamber (6) first of all allows easy access by an operator to all the mechanical elements of the machine, such as bearings, motor gears, cylinders, etc. It also facilitates the replacement of the flexible porous layers to be deposited and fixed on the gratings giving the decks their mechanical integrity. The inner chamber (6) can also be used to house the motors (7, 7*a*) driving the rotation of the decks, as well as the fans used to generate the hot gas flow, with the advantage of a substantial reduction of noise pollution generated by the dryer. In the case of a gas flow from top to bottom as represented in FIGS. 2(*b*) and 4, windows (6*a*) at the bottom of the inner chamber (6), situated below the lower deck, make it possible to recover the hot gas and discharge it through the top into the chamber. Moreover, it makes it possible to fix the distribution means (2*a*, 2*b*) and recovery means (3*a*, 3*b*) at their two ends in order to avoid having to fix them overhanging on the outer chamber only. Furthermore, this frees up space at the inner ends of said means situated side-by-side to accommodate their width. Finally, such a structure makes it possible to increase the rigidity of the surface lying between the inner (6) and outer (10) chambers, making it possible to retain a good flatness for the decks. This is important for the cleaning and recovery of the particles by a scraper or a brush, which are effective only if the surface of the decks is perfectly flat.

Figure 7:
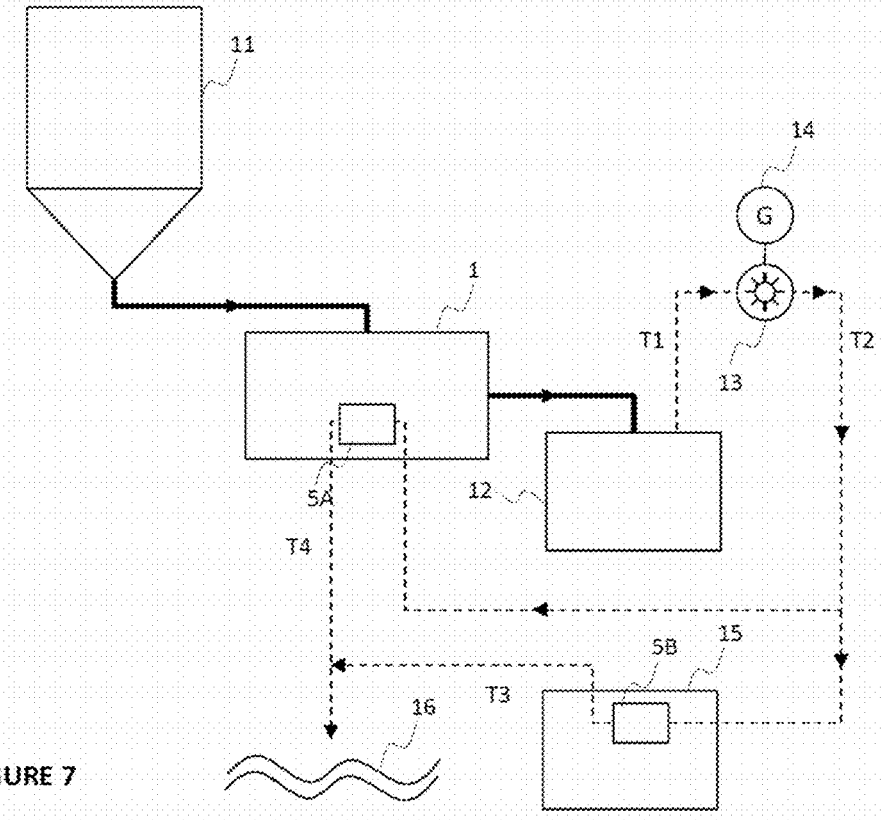
FIG. 7: illustrates an example of installation comprising a dryer according to the present invention for the drying of waste with a view to its use as fuel.

A dryer according to the present invention can be incorporated in a particle treatment installation. For example, the first means (2*a*) for distributing particles to be dried of a dryer according to the invention can be linked upstream to a source (11) of said particles to be dried, such as a silo. A silo can thus store particles comprising sawn wood waste, wood waste from construction material, paper or cardboard waste, agri-foodstuff products such as cereals. These particles can be in the form of powder, granules, chips, pellets, cakes, or pieces generally not exceeding 10 cm in length. The dryer can be linked downstream to a dry particle storage unit such as a silo or a packaging line. In the case of an installation for drying waste with a view to its use as fuel as represented in FIG. 7, the dryer can be linked downstream to a boiler (12) in order to supply it with particles of organic matter dried by the dryer as fuel. Said boiler (12) can itself be linked downstream to an electrical current generator (14) via a turbine (13) supplied with steam at a temperature, T1, by the boiler. The steam, having lost some of its energy in the turbine, has no more than a temperature T2<T1 and can be sent to a heat exchanger (5A, 5B) to heat the air of the hot air blowing means (5) of the dryer (1) and/or to heat any other installation, including another dryer (15). If more than one dryer is included in the same installation, it is possible, in order to save space on the ground, to superpose two, even more dryers according to the invention one on top of the other.

Figure 8:
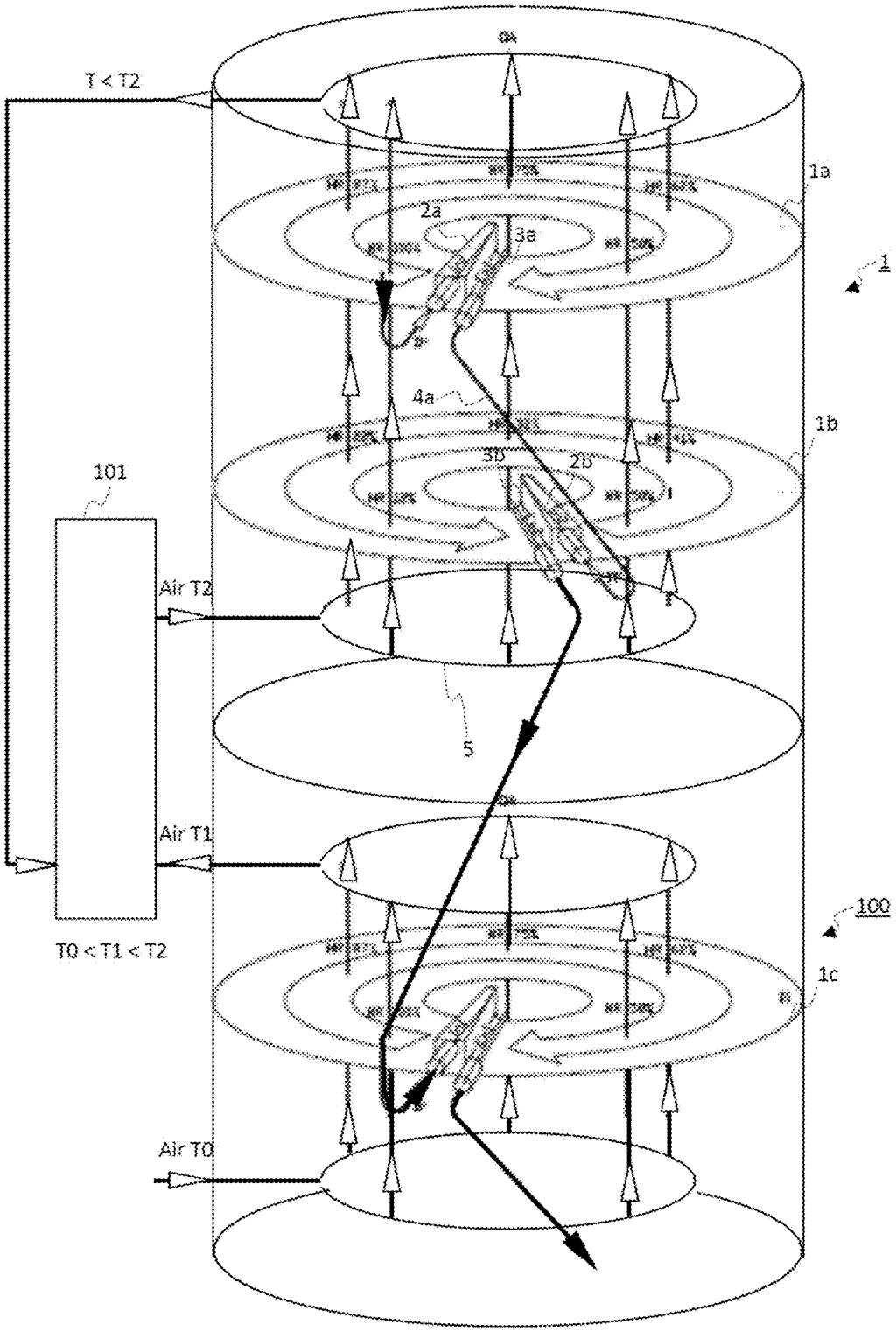
FIG. 8: illustrates an installation according to the present invention provided with an additional deck for cooling the dried particles.

FIG. 8 shows a variant of the present invention, in which a dryer (1) as represented in FIG. 3(*a*) is linked in series to a third rotating deck (1*c*) situated downstream of the second deck (1*b*) and enclosed in a cooling chamber (100). At the end of the drying operation, the particles discharged from the second deck (1*b*) are at a high temperature (see temperature of the particles at the point G of FIG. 6). For some types of powders, notably foodstuffs, it is not possible to package them at high temperature, for example in order to avoid excessive formation of condensation. To avoid having to store powders pending their cooling and to be able to package them directly after drying, the dried powders can be routed into a cooling chamber (100) where cold air at a temperature T0 of the order of 0 to 20° C. is blown through the third deck (1*c*). The air, substantially reheated to a temperature T1>T0, of the order of 40-55° C., is then recovered and introduced into an air heating system (101) making it possible to heat the air to a temperature T2>T1>T0, of the order of 100-110° C., which is blown into the dryer as explained in detail above. The air recovered after drying can also be returned to the heating system (101), but, since it is saturated with moisture, it is essential to determine, depending on the case, whether this is advantageous or not. It must be noted that the same installation as illustrated in FIG. 8 can be obtained with a dryer (1) as represented in FIG. 4(*a*) simply by arranging the cooling chamber (100) above the dryer (1) of FIG. 4(*a*).

The invention claimed is:

1. A dryer for drying particles comprising, (a) a chamber comprising an essentially cylindrical wall extending along a vertical axis, Z, (b) a first circular deck mounted on the wall of said chamber substantially normal to the vertical axis, Z, and rotating in a first direction about the vertical axis, Z, the surface of the first deck being perforated, and permeable to the gases including air and steam and to water, and (c) a second circular deck mounted at a certain distance from the first deck on the wall of said chamber substantially normal to the vertical axis, Z, and rotating about said vertical axis, Z, in the reverse direction of rotation of the first deck, the surface of the second deck being perforated and permeable to the gases including air and steam and to water, (d) a blowing hot gas means for blowing hot gas in a flow substantially parallel to the axis Z, passing first through the perforated surface of the second deck before passing directly after through the perforated surface of the first deck, (e) a first distribution means for distributing said particles to be dried suitable for distributing said particles before drying along a radius of the first deck, (f) a recovery means for recovering the particles deposited on the first deck after a rotation of a given angle thereof, said recovery means being situated downstream of the first distribution means, and (g) a means for transferring the particles collected from the first deck by the recovery means to a second distribution means suitable for distributing said particles along a radius of the second deck.

2. The dryer according to claim 1, wherein the first deck is situated below the second deck and in which the hot gas is hot air circulating from top to bottom.

3. The dryer according to claim 1, wherein the first deck is situated above the second deck and in which the hot gas is hot air circulating from bottom to top.

4. The dryer according to claim 1, wherein the first and second decks comprise a self-supporting rigid structure with high permeability of grating type, on which is placed a filtering layer comprising openings of size and density corresponding to the desired permeability according to the type and size of the particles to be dried.

5. The dryer according to claim 1, wherein the first and second distribution means for distributing the particles to be dried on the first and second decks, respectively, each comprise at least one Archimedes screw extending along the radius of the first and second decks, respectively, said at least one Archimedes screw being enclosed in a chamber provided with one or more openings extending along said radius of the decks.

6. The dryer according to claim 1, wherein the recovery means of the first deck comprises at least one Archimedes screw extending along a radius of the first deck that is enclosed in a chamber provided with one or more openings extending along said radius of the first deck, the one or more openings being linked to a scraper or brush adapted for collecting and directing the particles brought by the rotation of the first deck to the Archimedes screw.

7. The dryer according to claim 1, wherein the second deck comprises another recovery means for the particles deposited on the second deck after a rotation of a given angle thereof, the another recovery means being situated downstream of the second distribution means and being similar to the recovery means of the first deck.

8. The dryer according to claim 7, further comprising:

(h) at least one third circular deck mounted substantially horizontally at a certain distance from, and separated from the first deck by, the second deck, rotating about said vertical axis, Z, in the reverse direction of rotation of the second deck, the surface of the third deck being perforated and permeable to the gases including air and steam and to water, and (i) a means for transferring the particles collected from the second deck (1*b*) by the another recovery means to a third distribution means suitable for distributing said particles along a radius of the third deck.

9. The dryer according to claim 1, comprising a static floor situated below the lower deck situated lowest on said vertical axis, Z, the static floor comprising an opening for discharging the finest particles which would be deposited on the static floor, the dryer further comprising a scraper securely fixed to the lower deck and adapted for following the rotational motion thereof to push the particles deposited on the static floor to said opening.

10. The dryer according to claim 1, wherein the chamber is hollow allowing access to a person.

11. The dryer according to claim 1, wherein the first distribution means for said particles to be dried on the first deck is linked upstream to a source containing such particles to be dried, said particles comprising sawn wood waste, wood waste from construction materials, paper or cardboard waste, agri-foodstuff products including cereals, and are in the form of powder, granules, chips, pellets, cakes, or pieces generally not exceeding 10 cm in length.

12. The dryer according to claim 1, further comprising at least one second similar dryer superposed above the dryer.

13. The dryer according to claim 1, wherein the dryer is linked downstream to a boiler in order to supply the boiler with particles of organic material dried by the dryer as fuel, or to a dry particle storage unit.

14. The dryer according to claim 13, wherein the boiler is linked downstream to an electrical current generator via a turbine supplied with steam at a temperature, T1, by the boiler.

15. The dryer according to claim 14, wherein the steam or the liquid obtained from the turbine is sent at a temperature, $T2<T1$, to a heat exchanger to heat the gas or air of the hot air blowing means of the dryer and/or of another dryer.

16. The dryer according to claim 1, further comprising a cooling chamber situated downstream of the second deck, said cooling chamber comprising a third perforated deck rotating about the same axis as the first and second decks and provided with a source of cooling gas, at a temperature of between 0 and 20° C., making it possible to blow said cooling gas through the third deck in order to cool the dried particles.

17. A method for drying particles using the dryer according to claim 1, the method comprising (a) distributing the particles to be dried on the first circular deck mounted substantially horizontally and rotating in a first direction about a vertical axis, Z, the surface of the first deck being perforated and permeable to the gases including air and steam and to water, (b) after the rotation of the first deck by a certain angle, recovering the particles on said first deck and transferring them to and distributing them on, (c) a second circular deck mounted substantially horizontally at a certain distance from the first deck, and rotating about said vertical axis, Z, in the reverse direction of rotation of the first deck, the surface of the second deck being perforated and permeable to the gases including air and steam and to water, (d) blowing a hot gas in a flow substantially parallel to the axis Z, passing first through the particles distributed on, and through, the supporting second deck before passing directly after through the particles distributed on, and through, the first deck.

* * * * *